US006052999A

United States Patent [19]

Park et al.

[11] Patent Number: 6,052,999

[45] Date of Patent: Apr. 25, 2000

[54] METHOD FOR CONTROLLING OPENING/CLOSING OF COOL AIR DISCHARGE PORTS OF A REFRIGERATOR

[75] Inventors: Hae-jin Park, Suwon; Jae-in Kim, Seoul; Han-joo Yoo, Suwon, all of Rep. of Korea

[73] Assignee: Samsung Electronics Co., Ltd., Suwon, Rep. of Korea

[21] Appl. No.: 09/084,876

[22] Filed: May 28, 1998

[30] Foreign Application Priority Data

Jul. 23, 1997 [KR] Rep. of Korea ..... 97-34356
Jul. 23, 1997 [KR] Rep. of Korea ..... 97-34357
Jul. 26, 1997 [KR] Rep. of Korea ..... 97-35336

[51] Int. Cl.[7] ..... F24F 7/00; F25D 17/00

[52] U.S. Cl. ..... 62/179; 165/288; 236/78 B; 454/258

[58] Field of Search ..... 236/49.3, 78 B; 62/179, 209; 165/288; 454/258

[56] References Cited

U.S. PATENT DOCUMENTS 5,785,244 7/1998 McBroom ..... 236/49.3
5,884,491 3/1999 Kim et al. ..... 236/78 B

FOREIGN PATENT DOCUMENTS 6-20772 7/1994 Japan .

*Primary Examiner*—William Wayner
*Attorney, Agent, or Firm*—Burns, Doane, Swecker & Mathis, L.L.P.

[57] ABSTRACT

A method for controlling opening/closing of cool air discharge ports of a refrigerator is disclosed. The refrigerator has a device for opening/closing the ports. The device has a member for opening/closing the ports, and a motor for driving the member. A microcomputer measures temperatures at positions in a cooling compartment, and calculates a difference between the measured temperatures. When the difference is more than a predetermined value, the motor is driven so that the member repeats opening and closing of the ports. Then, the circulation effect of the cool air in the cooling compartment is enhanced, and the temperature in the cooling compartment maintained uniform.

7 Claims, 4 Drawing Sheets

METHOD FOR CONTROLLING OPENING/CLOSING OF COOL AIR DISCHARGE PORTS OF A REFRIGERATOR

BACKGROUND OF THE INVENTION

1. Field of the Invention

The present invention relates to a method for controlling opening/closing of cool air discharge ports for supplying a cooling compartment of a refrigerator with cool air.

2. Related Art

In general, as shown in FIG. 1, a refrigerator has a compressor 14 for compressing refrigerant, an evaporator 7 for generating cool air by evaporating the refrigerant supplied from the compressor 14, and a fan 10 for blowing the cool air generated by the evaporator 7. A duct member 12 for forming a cool air duct is installed at the rear part of a fresh food compartment 3. The duct member 12 has a plurality of cool air discharge ports 13 opened in the fresh food compartment 3. The cool air blown by the fan 10 flows into the cool air duct, and then is supplied into the fresh food compartment 3 through the cool air discharge ports 13.

The fresh food compartment 3 is opened and closed by a door 2, and the fresh food compartment 3 is partitioned into a plurality of spaces by shelves 4. At the upper part of the fresh food compartment 3, a cover 5 for shielding the evaporator 7 is installed. The evaporator 7 is fixed by a holder 8 in a space 6 formed by the cover 5.

While the refrigerator operates, frost is generated on the evaporator 7. The cooling efficiency of the evaporator 7 is lowered by the frost. Hence, the refrigerator is equipped with a heater 9 for removing the frost, and performs defrosting operation by heating the evaporator 7 using the heater 9 when the refrigerator is used more than a predetermined period of time.

In the fresh food compartment 3, a temperature sensor (not shown) is installed. When the temperature measured by the temperature sensor is higher than a temperature set by a user, the refrigerator begins to operate the compressor 14 and the fan 10. Then the evaporator 7 generates cool air, and the cool air is supplied into the cool air duct by the fan 10. The cool air supplied into the cool air duct is discharged into the fresh food compartment 3 through the cool air discharge ports 13, and thereby the food stored in the fresh food compartment 3 is cooled.

Meanwhile, a refrigerator equipped with a device for controlling the amount of cool air supplied through the cool air discharge ports 13 has been proposed. Such a device (not shown) is comprised of an opening/closing member disposed near the duct member 12 and a motor for driving the opening/closing member. The refrigerator drives the motor so that the cool air discharge ports 13 are opened or closed by the opening/closing member according to the temperature in the fresh food compartment 3. Then the amount of the cool air supplied into the fresh food compartment 3 is controlled.

However, in such a conventional refrigerator, there is a problem that the temperature in the fresh food compartment 3 cannot be maintained uniform since the opening/closing member merely performs opening or closing operation of the cool air discharge ports 13. In other words, when the cool air discharge ports 13 are open, the cool air is concentrated on an area adjacent to the cool air discharge ports 13, so the area adjacent to the cool air discharge ports 13 is apt to be overcooled in comparison with the area adjacent to the door 2.

Moreover, if the temperature in the fresh food compartment 3 is measured in a specific position at which temperature is high, the cool air is continuously supplied into the fresh food compartment 3 until the temperature of the measuring position reaches to the temperature set by the user, so the food placed at the other positions may be overcooled.

SUMMARY OF THE INVENTION

The present invention has been proposed to overcome the above described problems in the prior art, and accordingly it is the object of the present invention to provide a method for controlling the supply of cool air through the cool air discharge ports so that the uneven distribution of the temperature in a cooling compartment does not occur.

To achieve the above object, the present invention provides a method for controlling an operation for opening/closing cool air discharge ports of a refrigerator, the refrigerator having an opening/closing member for opening/closing the cool air discharge ports for supplying a cooling compartment with cool air and a motor for driving the opening/closing member, the method comprising the steps of: measuring temperatures at a plurality of positions in the cooling compartment; calculating a temperature difference between the measured temperatures; and controlling the motor so that the opening/closing member repeats to open and close the cool air discharge ports when the temperature difference is greater than a predetermined value.

If the temperature difference is smaller than the predetermined value, the open degree of the cool air discharge ports is controlled on the basis of the measured temperatures. The open degree is controlled by controlling the motor so that the cool air discharge ports are totally opened when an average temperature of the measured temperature is higher than a predetermined temperature and the cool air discharge ports are partially opened when the average temperature is lower than the predetermined temperature.

Preferably, the motor is a step motor.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
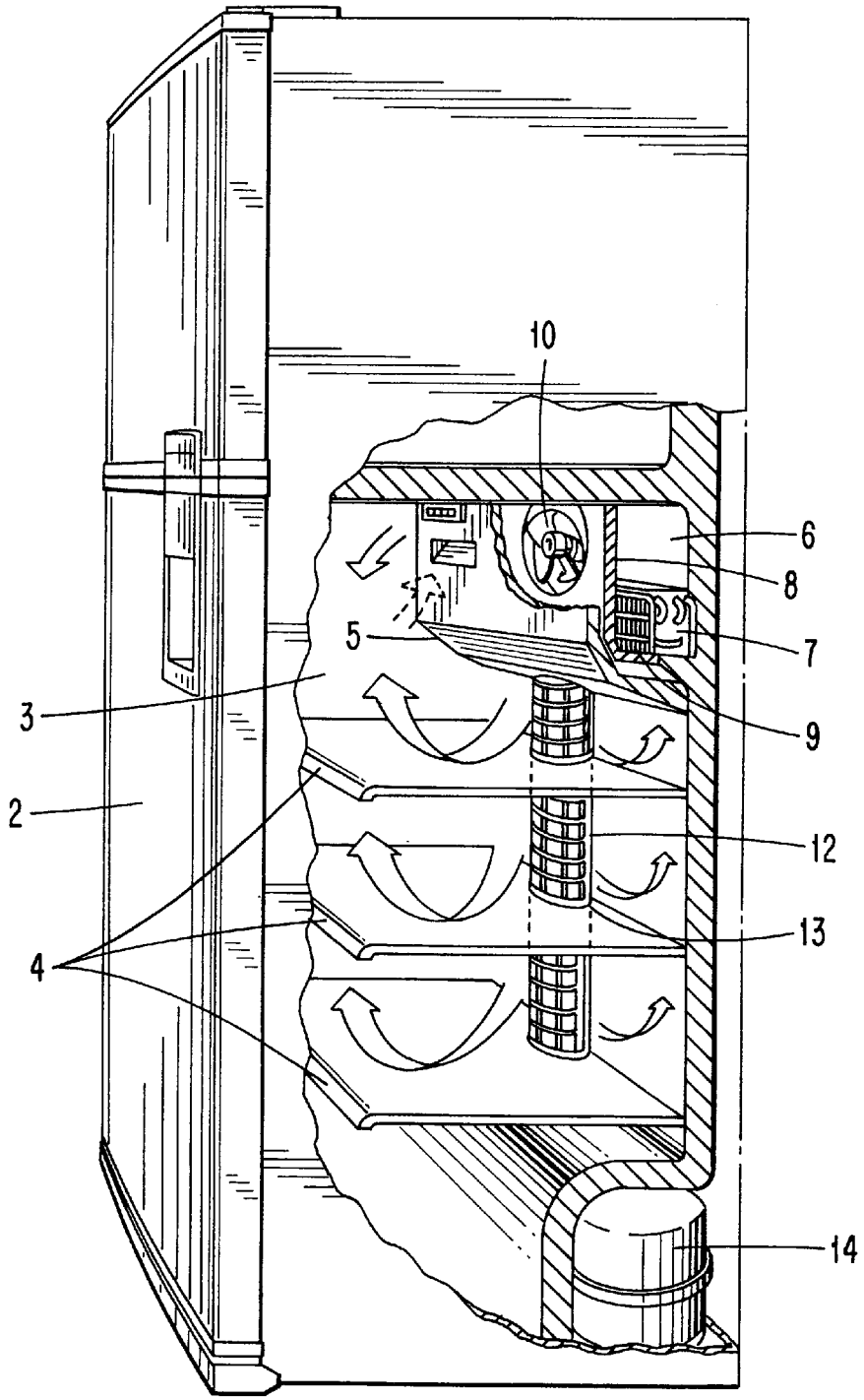
FIG. 1 (PRIOR ART)
FIG. 1 is a partial cutaway perspective view of a general refrigerator.

Hereinafter, the present invention will be described in detail with reference to the drawings. The same parts with the parts of the conventional refrigerator shown in FIG. 1 will be referred to with the same reference numerals, and the description thereof will be omitted.

Figure 2:
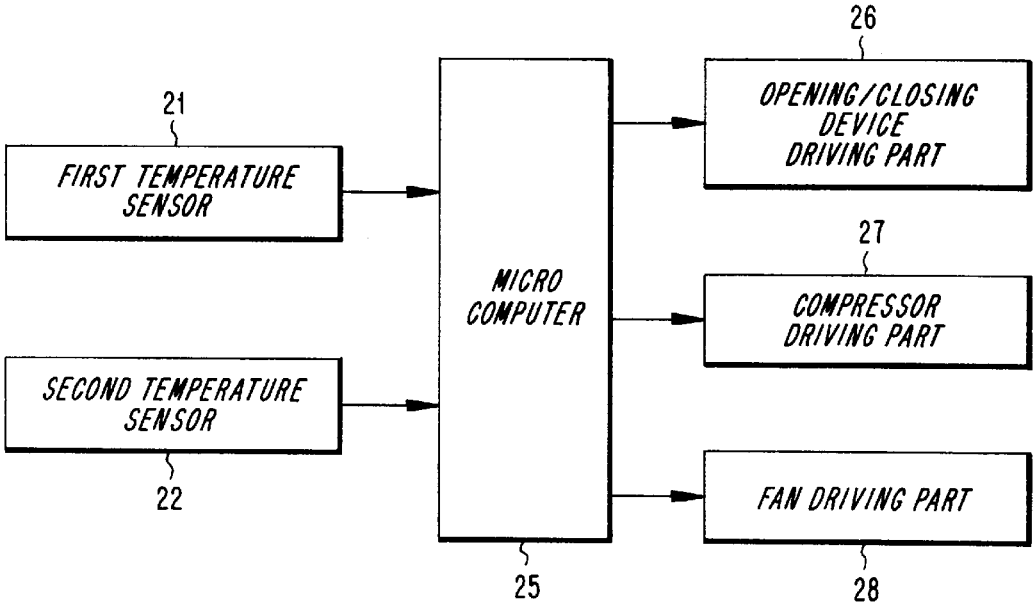
FIG. 2 is a block diagram of a control device of a refrigerator according to the present invention.

FIG. 2 is a block diagram of a control device of a refrigerator according to the present invention. The refrigerator has a microcomputer 25 for controlling the overall operation of the refrigerator, a first and a second temperature sensors 21 and 22 for measuring the temperature in the fresh food compartment 3, an opening/closing device driving part 26 for driving an opening/closing device, a compressor driving part 27 for driving the compressor 14, and a fan driving part 28 for driving the fan 10.

The first and the second temperature sensors 21 and 22 measure the temperatures of the different positions in the fresh food compartment 3. The temperatures measured respectively by the first and the second temperature sensors 21 and 22 are inputted to the microcomputer 25. The driving parts 26, 27, and 28 are controlled by the microcomputer 25.

Figure 5:
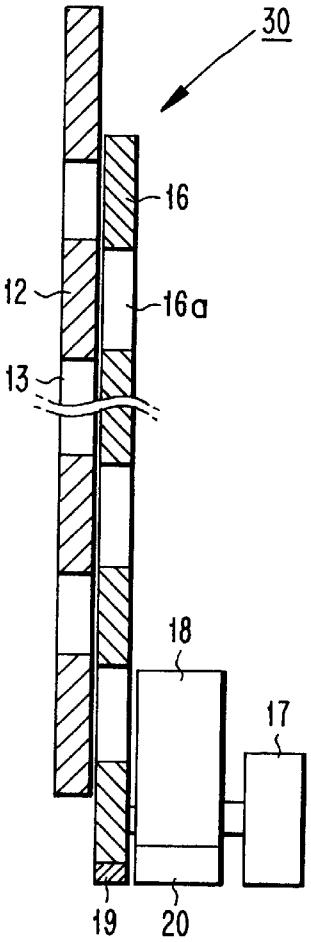
FIGS. 3 through 5 are side sectional views showing the operation of the opening/closing device controlled by the control method according to the present invention.
Figure 4:
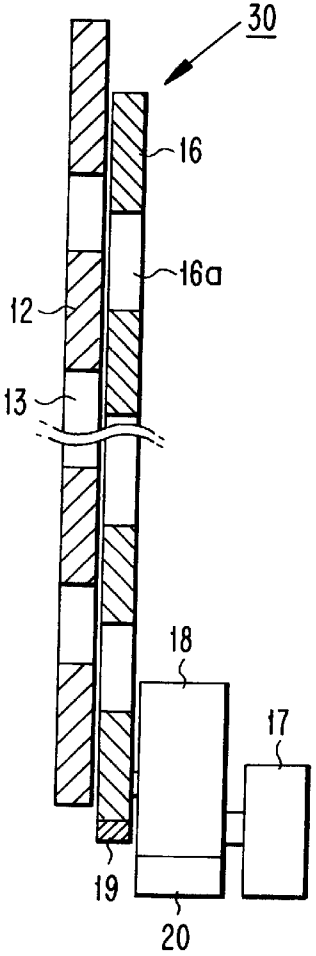
Figure 3:
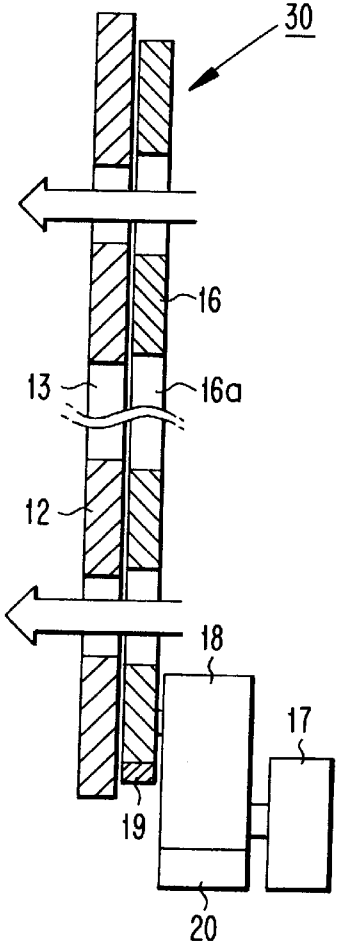

The opening/closing device 30 for opening/closing the cool air discharge ports 13 is, as shown in FIGS. 3 through 5, comprised of an opening/closing member 16 being disposed near the duct member 12 and for opening/closing the cool air discharge ports 13, a motor 17 for driving the opening/closing member 16, and a power transmission 18 for transmitting the power of the motor 17.

The opening/closing member 16 is formed with a plurality of air holes 16*a*. According to the position of the opening/closing member 16, the cool air discharge ports 13 of the duct member 12 are open as shown in FIG. 3, or close as shown in FIG. 5.

The power transmission 18 is comprised of a cam and gears, which converts rotational movement of the motor 17 to up-and-down movement of the opening/closing member 16. A reed switch 20 is installed at the lower part of the power transmission 18, and a magnet 19 for driving the reed switch 20 is installed at the lower part of the opening/closing member 16. When the opening/closing member 16 is moved down by the operation of the motor 17, the cool air discharge ports 13 are close as shown in FIG. 3, whereby the reed switch 20 is turned on by the magnet 19. Then, the microcomputer 25 senses the completion of the closing operation of the opening/closing member 16, and stops operating the motor 17.

The motor 17 is driven by the opening/closing device driving part 26 controlled by the microcomputer 25. The motor 17 is a step motor which can be driven bilaterally. Since the rotational position of the step motor can be exactly controlled, it is easy to control open, partial open, and close states shown in FIGS. 3 through 5 respectively. Furthermore, since the motor 17 can be controlled bilaterally, the conversion of the state among the states shown in FIGS. 3 through 5 is rapidly performed. In other words, if a motor which can be rotated in one direction is adopted, the opening/closing member 16 is operated in a serial order of open, partial open, close, partial open, and open states, so a number of steps will be required in order to convert from the partial open state to open state or to close state. However, the selective and direct conversion from the partial open state to the open state or to the close state can be performed according to the rotational direction of the motor 17 which is the step motor capable of being driven bilaterally.

Figure 6:
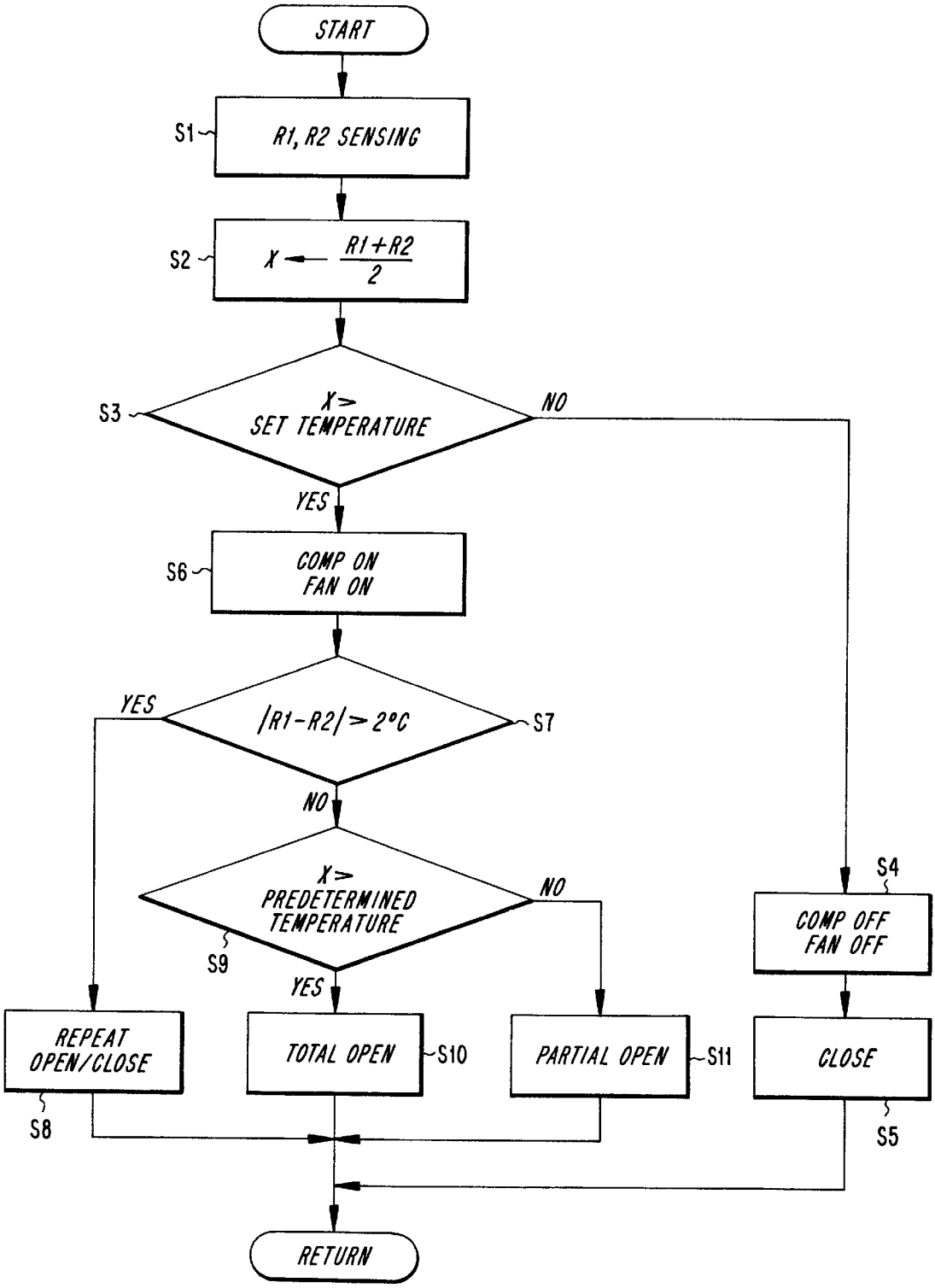
FIG. 6 is a flow chart showing the control method according to the present invention.

FIG. 6 is a flow chart showing the control method according to the present invention.

During the operation of the refrigerator, the microcomputer 25 measures S1 the temperatures R1 and R2 at two positions in the fresh food compartment 3 using the first and the second temperature sensors 21 and 22. The microcomputer 25 calculates S2 the average temperature X of the measured temperatures R1 and R2. The microcomputer 25 compares S3 the average temperature X with a set temperature which is a temperature corresponding to the cooling intensity preset by a user.

If the average temperature X of the fresh food compartment 3 is lower than the set temperature, the fresh food compartment 3 lies in condition that is sufficiently cooled. Therefore, the microcomputer 25 controls the compressor driving part 27 and the fan driving part 28 to stop S4 operating the compressor 14 and the fan 10, and controls the opening/closing device driving part 26 to close S5 the cool air discharge ports 13 as shown in FIG. 5. Then, the cool air is not generated in the evaporator 7 and the supply of the cool air into the fresh food compartment 3 is stopped.

If the average temperature X of the fresh food compartment 3 is higher than the set temperature, the fresh food compartment 3 lies in condition that is not sufficiently cooled to the temperature desired by the user. Accordingly, the microcomputer 25 controls the compressor driving part 27 and the fan driving pat 28 to operate S6 the compressor 14 and the fan 10. Then the evaporator 7 generates cool air.

Then, the microcomputer 25 calculates the difference between the measured temperatures R1 and R2, and judges S7 whether the temperature difference is more than two degrees centigrade or not. If the temperature difference is more than two degrees centigrade, the microcomputer 25 judges that the temperature in the fresh food compartment 3 is not maintained uniform, and if the temperature difference is less than two degrees centigrade, the microcomputer 25 judges that the temperature in the fresh food compartment 3 is maintained uniform. Here, the criterion for judging whether the temperature in the fresh food compartment 3 is maintained uniform or not has been exampled with the temperature difference of two degrees centigrade, however, it can be determined differently in consideration of the size, kind, etc of the refrigerator.

When the temperature difference is higher than two degrees centigrade, the microcomputer 25 drives the motor 17 so that the opening/closing member 16 repeats S8 the opening/closing operation of the cool air discharge ports 13. The repetition of the opening/closing operation is performed by driving the motor 17 continuously in one rotational direction. That is, when the motor 17 is driven in one rotational direction continuously, the opening/closing member 16 repeats the open state and close state which are shown in FIG. 3 and FIG. 5, respectively. Then, the supply of the cool air through the cool air discharge ports 13 is performed intermittently, and the open degree of the cool air discharge ports 13 varies, whereby the flowing velocity of the cool air discharged through the cool air discharge ports 13 varies. Therefore, the circulation effect of the cool air in the fresh food compartment 3 is enhanced, and thereby the temperature in the fresh food compartment is maintained uniform.

If the temperature difference is below two degrees centigrade, the microcomputer 25 compares S9 the calculated average temperature X with a predetermined temperature. Here, the predetermined temperature is a little bit higher temperature than the set temperature set by the user. For example, if the temperature set by the user is four degrees centigrade, the predetermined temperature is six degrees centigrade. The predetermined temperature varies according to the set temperature, which is pre-programmed in the microcomputer 25.

If the average temperature X is higher than the predetermined temperature, the microcomputer 25 totally opens S10 the cool air discharge ports 13 as shown in FIG. 3. Then, plenty of cool air is supplied into the fresh food compartment 3 through the cool air discharge ports 13. If the average temperature X is lower than the predetermined temperature, that is, if the average temperature X is between the set temperature and the predetermined temperature, the microcomputer 25 partially opens S11 the cool air discharge ports 13 as shown in FIG. 4. Then, a small amount of cool air is supplied into the fresh food compartment through the cool air discharge ports 13. According to such a processes, the amount of cool air supplied into the fresh food compartment 3 is controlled according to the rising degree of temperature in the fresh food compartment 3, so the temperature in the fresh food compartment 3 is maintained to the set temperature efficiently.

As described above, according to the present invention, when the distribution of the temperature in the fresh food compartment is uneven, the opening and the closing of the cool air discharge ports are repeated in turn, whereby the temperature in the fresh food compartment becomes uniform. Furthermore, since the amount of supplied cool air is controlled according to the rising degree of the temperature, the set temperature is kept efficiently. In particular, according to the present invention, since the comparison of the set temperature and the temperature in the fresh food compartment is performed on the basis of the average temperature of the temperatures measured at a plurality of positions in the fresh food compartment, overcooling does not occur at one position even when the temperature at the other local position rises.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method for controlling an operation for opening/closing cool air discharge ports of a refrigerator, said refrigerator having an opening/closing member for opening/closing the cool air discharge ports for supplying a cooling compartment with cool air and a motor for driving said opening/closing member, said method comprising the steps of:

measuring temperatures at a plurality of positions in said cooling compartment;

calculating a temperature difference between the measured temperatures; and controlling said motor so that said opening/closing member repeats to open and close the cool air discharge ports when the temperature difference is greater than a predetermined value.

2. The method for controlling an operation for opening/closing cool air discharge ports of a refrigerator as claimed in claim 1, wherein the plurality of positions are two positions.

3. The method for controlling an operation for opening/closing cool air discharge ports of a refrigerator as claimed in claim 2, wherein the predetermined value is two degrees centigrade.

4. The method for controlling an operation for opening/closing cool air discharge ports of a refrigerator as claimed in claim 1, further comprising a step of controlling an open degree of the cool air discharge ports on the basis of the measured temperatures when the temperature difference is smaller than the predetermined value.

5. The method for controlling an operation for opening/closing cool air discharge ports of a refrigerator as claimed in claim 4, wherein said step of controlling the open degree comprises the steps of:

calculating an average temperature of the measured temperature; and controlling said motor so that the cool air discharge ports are totally opened when the average temperature is higher than a predetermined temperature and the cool air discharge ports are partially opened when the average temperature is lower than the predetermined temperature.

6. The method for controlling an operation for opening/closing cool air discharge ports of a refrigerator as claimed in claim 5, wherein said motor is a step motor.

7. A method for controlling an operation for opening/closing cool air discharge ports of a refrigerator, said refrigerator having a compressor for compressing refrigerant, an evaporator generating cool air when said compressor operates, a fan for blowing the cool air generated by said evaporator, an opening/closing member for opening/closing the cool air discharge ports through which the cool air blown by said fan is supplied into a cooling compartment, and a motor for driving said opening/closing member, said method comprising the steps of:

measuring temperatures at a plurality of positions in said cooling compartment;

calculating an average value of the measured temperatures;

driving said compressor and said fan when the average value is higher than a set temperature which corresponds to a cooling intensity preset by a user, and stopping operation of said compressor and said fan when the average value is lower than the set temperature;

calculating a temperature difference between the measured temperatures during the operation of said compressor and said fan; and controlling said motor so that said opening/closing member repeats to open and close the cool air discharge ports when the temperature difference is greater than a predetermined value, and so that the higher the average temperature is, the greater an open degree of the cool air discharge ports becomes.

* * * * *